US005281160A

United States Patent [19]

Walkup et al.

[11] Patent Number: 5,281,160

[45] Date of Patent: Jan. 25, 1994

[54] ZERO DISENGAGEMENT FORCE CONNECTOR WITH WIPING INSERTION

[75] Inventors: William B. Walkup, Huntington; Rocco J. Noschese, Wilton, both of Conn.

[73] Assignee: Burndy Corporation, Norwalk, Conn.

[21] Appl. No.: 788,967

[22] Filed: Nov. 7, 1991

[51] Int. Cl.[5] ..... H01R 11/22

[52] U.S. Cl. ..... 439/266; 439/268

[58] Field of Search ..... 439/259, 262, 263, 264, 439/265, 266, 268, 269

[56] References Cited

U.S. PATENT DOCUMENTS

| | | | |
|---|---|---|---|
| 3,526,869 | 9/1970 | Conrad et al. | 339/75 |
| 3,553,630 | 1/1971 | Scheingold et al. | 339/74 |
| 3,683,317 | 8/1972 | Walkup | 339/75 |
| 3,899,234 | 8/1975 | Yeager et al. | 339/74 R |
| 4,047,782 | 9/1977 | Yeager | 339/75 MP |
| 4,133,592 | 1/1979 | Cobaugh et al. | 339/17 M |
| 4,159,861 | 7/1979 | Anhalt | 339/75 MP |
| 4,165,909 | 8/1979 | Yeager et al. | 339/75 MP |
| 4,636,021 | 1/1987 | Bobb et al. | 339/75 MP |
| 4,684,194 | 8/1987 | Jenkins et al. | 439/260 |
| 4,705,338 | 11/1987 | Sitzler | 439/260 |
| 4,836,798 | 6/1989 | Carter | 439/268 |
| 4,842,538 | 6/1989 | Noschese | 439/260 |
| 4,889,499 | 12/1989 | Sochor | 439/268 |
| 5,002,499 | 3/1991 | Matsuoka | 439/259 |
| 5,037,321 | 6/1991 | Uratsuji et al. | 439/259 |

FOREIGN PATENT DOCUMENTS

| | | | |
|---|---|---|---|
| 8400256 | 1/1984 | PCT Int'l Appl. | 439/266 |
| 2083298 | 3/1982 | United Kingdom | 439/266 |

*Primary Examiner*—Larry I. Schwartz
*Assistant Examiner*—Hien D. Vu
*Attorney, Agent, or Firm*—Perman & Green

[57] ABSTRACT

An electrical connector for connecting a second electrical connector to a printed circuit board. The electrical connector has a housing with spring contacts. The spring contacts are adapted to be displaced by and make electrical and mechanical contact with contact pins of the second electrical connector inserted into the housing. The electrical connector further comprises a contact disconnector for moving the spring contacts away from the contact pins for easier disconnection of the second electrical connector from the electrical connector.

5 Claims, 3 Drawing Sheets

ZERO DISENGAGEMENT FORCE CONNECTOR WITH WIPING INSERTION

BACKGROUND OF THE INVENTION

1. Field of the Invention

The present invention relates to electrical connectors and, more particularly, to an electrical connector that is adapted to wipe contacts of a second electrical connector while being connected thereto and have the contacts of the electrical connector disengaged from the contacts of the second electrical connector for easier disconnection of the two connectors and, a method of manufacturing the same.

2. Prior Art

Electrical connectors that have spring contacts and electrical connectors that can move these spring contacts for easier insertion of a printed circuit board or contacts of a second electrical connector are well know in the art as can be seen by review of U.S. Pat. Nos. RE 29,223; 4,842,538; 4,705,338; 4,684,194; 4,636,021; 4,165,909; 4,159,861; 4,047,782; 3,899,234; 3,683,317; 3,553,630; and 3,526,869. A problem exists with zero insertion force (ZIF) connectors and low insertion force connector in that they do not provide a good contact wipe between contacts. As is known in the art, contact wipe between contacts allows for a good electrical connection by wiping away non-conductive material from between the contacts.

A good contact wipe is provided by contacts such as disclosed in U.S. Pat. No. 4,934,961 that exert a uniform wiping action against a contact or contact trace. However, a problem exists with these types of constant pressure contacts in that they unnecessarily exert pressure during withdrawal or disconnection.

It is therefore an objective of the present invention to provide a new and improved electrical connector.

SUMMARY OF THE INVENTION

The foregoing problems are overcome and other advantages are provided with a new and improved zero disengagement force connector with wiping insertion action and a method of manufacturing the same.

In accordance with one embodiment of the present invention, an electrical connector is provided comprising a housing, a plurality of spring contacts connected to the housing, and means for moving portions of the spring contacts. The housing is comprised of dielectric material and has contact receiving areas therein. The plurality of spring contacts include at least some of the contacts having a first section adapted to make electrical contact with an electrical component and a second section extending into one of the contact receiving areas. The second section has a home position at least partially in a path of insertion of a second connector contact into the contact receiving area, but is adapted to be moved by the second connector contact when it is inserted into the contact receiving area to thereby make an electrical and mechanical connection between the two contacts. The means for moving can move the second sections independently away from the second connector contacts for easier removal of the second connector contacts from the receiving areas.

In accordance with another embodiment of the present invention an electrical connector is provided comprising a housing, a plurality of spring contacts, means for electrically and mechanically connecting pin contacts of a second electrical connector to the spring contacts, and means for disconnecting the pin contacts from the spring contacts. The housing has contact receiving channels with the spring contacts connected to the housing. The means for electrically and mechanically connecting pin contacts of a second electrical connector the spring contacts includes the spring contacts having a home position in the contact receiving channels and being adapted for displacement, at least partially, from their home positions to a first displaced position by insertion of the pin contacts into the contact receiving channels. The means for disconnecting can disconnect the pin contacts from the spring contacts and includes means for displacing the spring contacts from their first displaced position to a second displaced position.

In accordance with one method of the present invention, a method of manufacturing an electrical connector is provided comprising steps of providing a housing having contact receiving areas; connecting contacts to the housing, the contacts having first sections that extend, at least partially, into the contact receiving areas in home positions, the contacts being adapted to be displaced from their home positions by contact pins from a second electrical connector which deflect the first sections during insertion of the pins into the contact receiving areas to thereby make electrical and mechanical contact between the contacts and contact pins; and connecting at least one movement bar to the housing; the movement bar being movably mounted to the housing and being adapted to move the contact first sections from positions against the contact pins to positions spaced from the contact pins.

In accordance with another embodiment of the present invention an electrical connector is provided comprising a housing, spring contacts, and means for moving the spring contacts. The housing comprises an elongate housing having a longitudinal axis with at least one row of contact receiving areas. The spring contacts are connected to the housing. The means for moving the spring contacts comprises at least one push button control at a longitudinal end of the housing, the control being adapted to be pressed towards the housing parallel to the longitudinal axis of the housing.

BRIEF DESCRIPTION OF THE DRAWINGS

The foregoing aspects and other features of the present invention are explained in the following description, taken in connection with the accompanying drawings, wherein.

DETAILED DESCRIPTION OF THE INVENTION

Figure 1:
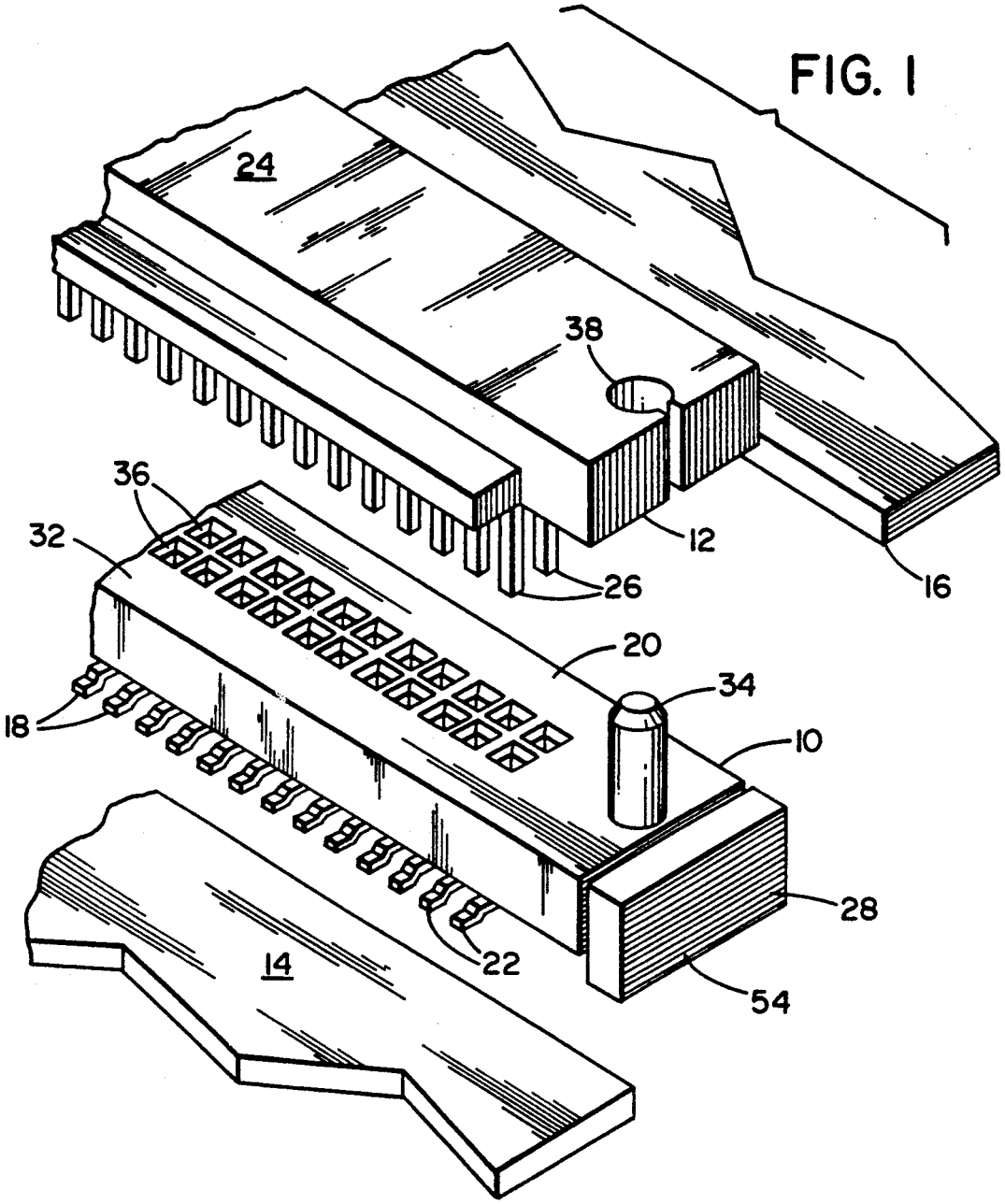
FIG. 1 is an exploded perspective view of portions of two electrical components and portions of two electrical connectors; one of the electrical connectors comprising features of the present invention.
Figure 2:
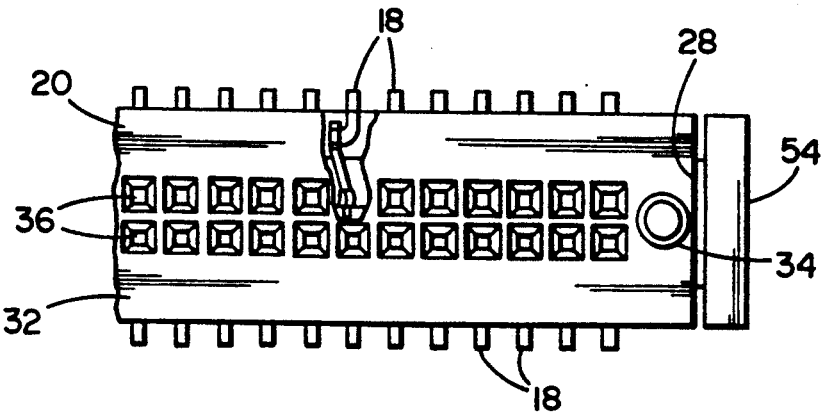
FIG. 2 is a partial plan top view of one of the connectors shown in FIG. 1 with a partial cut-away section showing one of its contacts.

Referring to FIG. 1, there is shown a partial exploded perspective view of two electrical connectors 10 and 12 adapted to make electrical connection between two parallel electrical or electronic components 14 and 16. Although the present invention will be described with reference to the embodiments shown in the drawings, it should be understood that the present invention can be used in a variety of different embodiments and to connect various different types of electrical or electronic components. In addition, any suitable size, shape, or type of elements or materials could be used.

In the embodiment shown in FIG. 1, the first electronic component 14 is a host printed circuit board and the second electronic component 16 is a small hard disk drive such as a 2.5 inch or 1.8 inch hard disk drive. However, as noted above, the connectors 10 and 12 may be used to connect any suitable type of electronic components. The first connector 10 generally comprises contacts 18 and a housing 20. The tail ends 22 of the contacts 18, in the embodiment shown, are soldered onto the first component 14. However, any suitable type of connection could be provided. The second connector 12 generally comprises a housing 24 and pin contacts 26. The first connector 10 is fixedly connected to the first component 14. The second connector 12 is fixedly connected to the second component 16. The two connectors 10 and 12 can be removably electrically and mechanically connected to each other in order to removably connect the two components 14 and 16 to each other. In the embodiment shown, the second connector 12 is substantially similar to connectors known in the art.

Referring now also to FIGS. 2-6, the features of the first electrical connector 10 will be described in greater detail. The connector 10 comprises the housing 20, two rows of spring contacts 18, and two substantially identical contact moving members or slides 28 and 30. The housing 20 is preferably comprised of a dielectric material and has an elongate length. The housing 20 has a top side 32 with two rows of contact receiving apertures 36 extending thereinto and two aligning and mounting posts 34 (only one of which is shown), one at each longitudinal end of the housing 20. The posts 34 are adapted to be inserted in holes 38 in the second connector 12. The housing 20 is adapted to receive the spring contacts 18 which are fixedly inserted into the housing 20. The housing 20 further comprises a longitudinal raceway or channel 40 along the longitudinal axis of the housing 20. In an alternate embodiment, multiple raceways could be provided.

Figure 6:
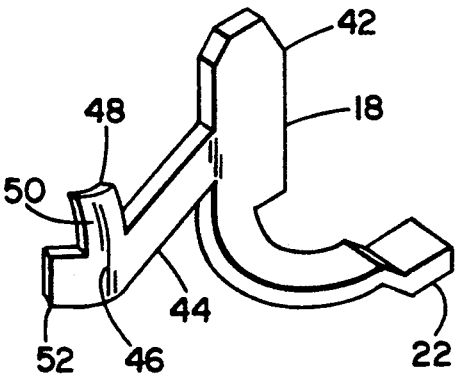
FIG. 6 is a perspective view of one of the spring contacts.

The contacts 18, as best seen in FIG. 6, are comprised of a sheet of metal that is cut, bent and stamped or coined. The contacts 18 include their tail ends 22 that extend out of the housing 20, middle sections 42 fixedly mounted in a receiving slot in the housing 20, and cantilevered contact arms 44. Each arm has a final contact area 46 that is preferably plated with gold that is intended to contact a pin 26 when the two connectors 10 and 12 are connected to each other. Each arm also has a ramp 48 with a ramp surface 50. The end 52 of each arm forms an area to allow movement of the arms 44 by the moving members 28 and 30 as further described below.

The moving members 28 and 30 are substantially identical to each other, but are movably mounted to the housing 20 in generally opposite orientations. Each of the moving members are preferably made of a dielectric material, such as a molder polymer, and have a general elongate length with a control or push button surface 54 at one longitudinal end. Of course, in an alternate embodiment the control 54 might be a separate member that is attached to the moving member. Each moving member or bar 28, 30 has a plurality of contact open areas 56 aligned in a row and portions 58 of those areas 56 specifically adapted to receive ends 52 of the contacts 18. The slides 28 and 30 are slidingly located in the housing longitudinal raceway 40 with the control 54 of the first moving member 28 at one longitudinal end of the housing 18 and a second control (not shown) for the second moving member 30 at an opposite longitudinal end of the housing. The second control is identical to the control 54, just located at an opposite end and connected to member 30 rather than member 28. Thus, the second control is not shown to simplify the drawings. The two slides 28 and 30 are placed adjacent each other in the raceway 40.

Figure 3:
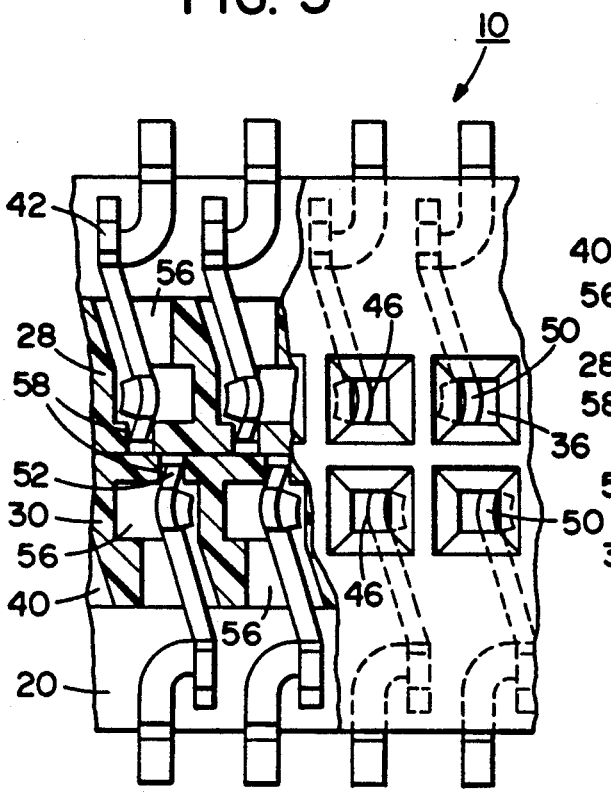
FIG. 3 is in enlarged top view of a portion of the connector shown in FIG. 2 with a partial cross-sectional view showing the contacts at a home position.

FIG. 3 illustrates a rest position of the connector 10. In the rest position, the contacts 18 have there middle sections 42 fixedly and stationarily mounted to the housing 20. The arms 44 of the two rows of contacts 18 extend towards the center axis of the connector into the contact open areas 56 of the slides 28 and 30. The ends 52 of the arms 44 are located in areas 58. In the embodiment shown, the spring contacts 18 bias the slides 28 and 30 in opposite directions. Suitable restraining ledges (not shown) are provided on the slides 28 and 30 and the housing 20 to limit or restrain relative movement of the slides in the housing. As can be seen from the plan top view section of FIG. 3, the final contact areas 46 and ramp surfaces 50 of the contacts 18 extend into a contact receiving area directly below top apertures 36. Thus, the ramp surfaces 50 are located in an intended path of insertion of pin contacts 26.

Figure 4:
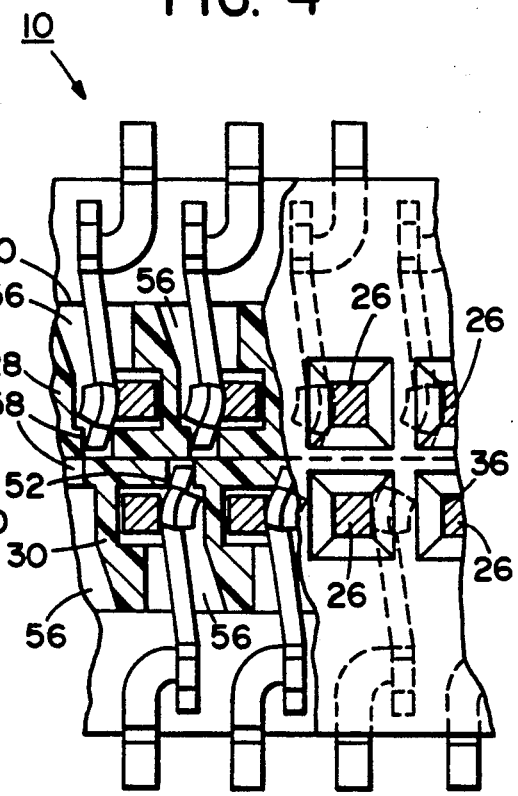
FIG. 4 is the connector as shown in FIG. 3 with pin contacts from the second electrical connector shown inserted into the first electrical connector.

Referring now particularly to FIG. 4, as well as the other figures, the connector 10 is shown with pins 26 of the second connector 12, shown in FIG. 1, in the contact receiving areas of the first connector 10. The connection of first connector 10 to the second connector 12 generally comprises the leading edges of contact pins 26 being located over the apertures 36, the posts 34 being located under holes 38, and merely pressing the two connectors 10 and 12 together. As the leading edges of the pins 26 contact the ramp surfaces 50 of the contacts 18, the arms 44 deflect to a first deflected position. As the arms 44 deflect the ends 52 of the arms 44 move the slides 28 and 30 in opposite directions. In the embodiment shown this causes the two controls 54 to move towards the longitudinal ends of the housing 20. In the final installed position shown in FIG. 4, the pin contacts 26 are sandwiched between or gripped on opposite sides by the contacts 18 and the housing 20. This establishes a mechanical and electrical connection between the two connectors.

Figure 5:
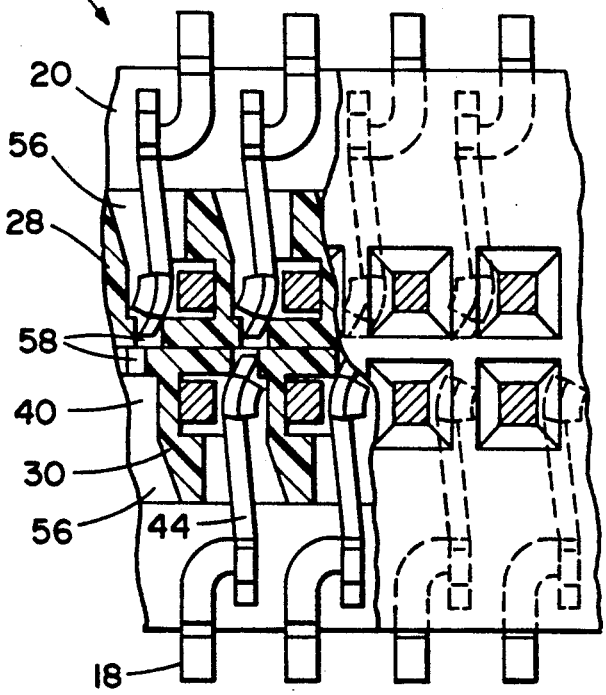
FIG. 5 is the connector and pin contacts of the second connector as shown in FIG. 4 with the spring contacts moved away from the pin contacts.

Referring particularly to FIG. 5, as well as the other figures, the connector 10 is shown at a disconnect position. The disconnect position is generally intended to allow for easier disconnection of the two connectors 10 and 12 by reducing the amount of force required to withdraw pins 26 from the first connector contact receiving areas. In order to disconnect the two connectors 10 and 12, a person would use a thumb and finger on the same hand and press on the two controls 54 to squeeze the controls towards each other and towards the longitudinal ends of the housing 20. This results in the two slides 28 and 30 longitudinally moving and, due to the fact that the contact arm ends 52 are in areas 58, the arms 44 are deflected to a further second deflected position. This results in the arms becoming disconnected and spaced from the contact pins 26. Therefore, the contact pins 26 are no longer clamped by the spring contacts 18 against the housing 20. This significantly reduces the amount of force needed to disconnect the two connectors from each other. The person could then merely use the other hand to pull one of the components away from the other component. In the embodiment shown, the amount of force needed to disconnect the two connectors is substantially low; virtually insignificant.

Recently, a new development has emerged for use in palm top and notebook computers; a very small disk hard drive unit (Suall Form Factor Hard Drive Assembly or SFFHDA). These computers, complete with the drive and the power supply, have weight of less than 2 kilograins. The issues of what type of connectors could be used is complicated because assembly will preferably be done by robots. The connector is preferably inexpensive and very small. Both the computer board or "host board", and the SFFHDA board are only 0.8 mm thick with a desire to go to 0.5 mm thickness. There are fifty connections to be made on a 1.25 mm grid spacing. However, it should be noted that the present invention can be embodied with any suitable number of connection or grid spacing. Electronic performance advantages gained by using surface mount solder connections apply to connectors as well as active components. Surface solder connectors are generally screwed to the board so the stresses of insertion and withdrawal are not transmitted through the solder connections. However, screws are unacceptable for the SFFHDA application. The boards can be supported during inserting of the drive, but multiple insertions and withdrawals brings a virtual certainty for failure for any system built with conventional connectors and boards that are so thin and structurally flexible.

Although printed circuit boards are rugged and adapted to withstand a lot of force as long as the force is in the plane of the board, when a load is placed perpendicular to the board, the board bends and trouble begins. Broken surface mounted solder connections can have serious consequences. Very thin boards and large boards react badly to flexing. What is needed is a connector that will contact the surface of the board and not apply force to the board that causing it to flex. Solder joints, or perhaps more correctly, the adhesive bonds that hold the traces on the boards, are relatively strong in compression. However, they are not strong in tension or shear.

The great majority of insertion and withdrawal forces with male and female connectors are the result of two things, geometry and friction. During insertion there is a frictional element from the first point of contact as well as an element of force needed to pry the contact open. This is known as the geometry component. These elements are additive until the lead-in of the male contact has passed the point of tangency on the arc of the female connector contact. Further insertion beyond that point is the result of only friction. The frictional element is mathematically described as the product of the normal force times the coefficient of sliding friction between the surfaces. If there is no motion, friction drops to zero, or its effect becomes invisible. During withdrawal, only friction plays a role until the male contact has been withdrawn past the point of tangency with the contact arc. Then the geometry component enters the picture again, and at this point it tries to expel the probe.

The design described above consists of cantilever beam contacts that are partially opened during insertion of conventional pins. To extract the pin array, or separate the two connectors, pressure is applied to the controls on the ends of the female connector 10. When the controls are depressed, the slide which is attached to each control moves through the body of the connector causing the cantilever beams contacts to be moved away from the pins. Once the contact is opened the contact force is eliminated, and so is the friction. The extraction force between the contacts goes to zero and the two halves of the connector separate with no bending force applied to either board. Finger pressure is not applied to the controls during insertion so there is good contact wiping action during connection of the two connectors. Thus, the present invention is particularly adapted for use with thin and structurally flexible printed circuit boards. Because the boards can be supported for accepting compressive loads perpendicular to the plane of the board, the contacts of the female connector of the present invention can act as a wiping spring contact that must be forcibly displaced. This allows the connector 10 to provide good contact wiping for good electrical connections to be formed between the two mating contacts. In addition, because the thin and structurally flexible printed circuit boards cannot be well supported for tension loads perpendicular to the plane of the board (at least not at a reasonable cost), the connector of the present invention can disengage the spring contacts from the pin contacts thereby eliminating virtually all substantial interactive contact between the connectors for a relatively tension free disconnection. Thus, the printed circuit board is substantially less likely to flex and be damaged and, may withstand hundreds of connections and disconnects of the two connectors.

Figure 7:
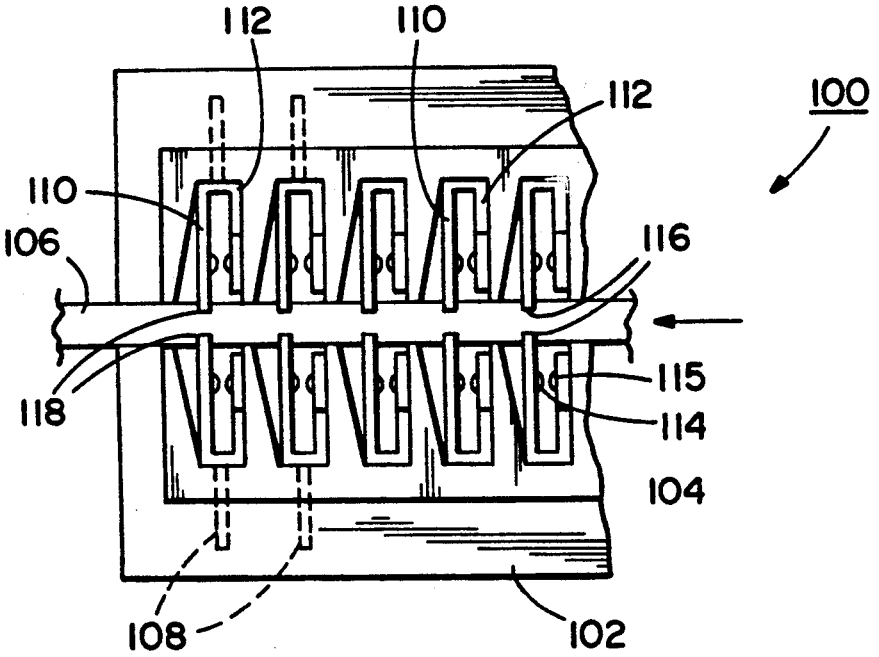
FIG. 7 is a partial schematic top view of an alternate embodiment of the present invention.

Referring now to FIG. 7, there is shown a schematic partial top view of an alternate embodiment of the present invention. In the embodiment shown, a female connector 100 is provided having a housing 102, contacts 104, and a slide 106. The contacts 104 each have a tail end 108 for connection to a printed circuit board (not shown) and two contact arms 110 and 112 extending parallel to each other. The first arm 110 is longer than the second arm 112. Each arm 110 and 112 has raised contact portions 114 and 115 for contacting a male contact from a second connector (not shown) inserted therebetween. The slide 106 has a plurality of notches 116 on both sides. The ends 118 of the first arms 110 are located in these notches 116. The slide 106 can be moved, as shown by arrow A to move first arms 110 away from their respective second arms 112. Thus, allowing easier removal of the male contacts from between the arms 110 and 112. Hence, a slide need not be provided for each row of contacts, but may control a plurality of rows of contacts. Of course, any suitable slide and contact arrangement could be provided.

Let it be understood that the foregoing description is only illustrative of the invention. Various alternatives and modifications can be devised by those skilled in the art without departing from the spirit of the invention.

Accordingly, the present invention is intended to embrace all such alternatives, modifications and variances which fall within the scope of the appended claims.

What is claimed is:

1. An electrical connector comprising:

a housing comprised of dielectric material and having contact receiving areas therein;

a plurality of spring contacts connected to the housing, at least some of the contacts each having a first section and a second section, the second section adapted to make electrical contact with an electrical component and the first section extending into one of the contact receiving areas, the first section having a home position at least partially in a path of insertion of a second connector contact in the contact receiving area, but being adapted to be moved by the second connector contact when the second connector contact is inserted into the contact receiving area to thereby make an electrical and mechanical connection between the two contacts;

means for wiping the second connector contacts with the spring contacts during insertion of the second connector contacts into the contact receiving areas; and means for moving the first sections independently away from the second connector contacts for easier removal of the second connector contacts from the receiving areas, wherein the means for moving comprises at least two members connected to ends of the first sections and movably mounted on the housing to move the first sections, the members each having a control at a separate longitudinal end of the housing adapted to be simultaneously pressed in towards the housing by a person's thumb and finger of a same hand to move the first sections, the connector having at least two rows of contact receiving areas.

2. A connector as in claim 1 wherein the spring contacts have ramp surfaces to provide a smooth camming action by the second connector contacts to move the spring contacts.

3. A connector as in claim 1 wherein the spring contacts and housing are adapted to sandwich the second connector contacts therebetween.

4. A connector as in claim 1 wherein the first sections extend transverse to the contact receiving areas.

5. A method of manufacturing an electrical connector comprising steps of:

providing a housing having contact receiving areas;

connecting contacts to the housing, the contacts having first sections that extend, at least partially, into the contact receiving areas in home positions, the contacts being positioned to be displaced from their home positions by wiping insertion of contact pins from a second electrical connector which deflect the first sections during insertion of the pins into the contact receiving areas to thereby make electrical and mechanical contact between the contacts and contact pins; and connecting at least one movement bar to the housing in a longitudinal raceway, the movement bar being movably mounted to the housing and being adapted to move the contact first sections from positions against the contact pins to positions spaced from the contact pins, the step of connecting at least one movement bar to the housing includes locating a control portion of the movement bar at a longitudinal end of the housing with the contacts biasing the bar such that control portion is spaced from the housing whereby the control portion can be pushed longitudinally towards the housing longitudinal end, and wherein the step of connecting at least one movement bar to the housing includes connecting at least two of the movement bars to the housing with the control portion of the first bar located at a first longitudinal end of the housing and the control portion of the second bar located at an opposite second longitudinal end of the housing.

* * * * *